United States Patent [19]

Finkelstein

[11] 4,274,573

[45] Jun. 23, 1981

[54] DISPENSER FOR WEB-LIKE MATERIAL

[76] Inventor: Oscar P. Finkelstein, 14/18 Ein Rogel St., Jerusalem, Israel

[21] Appl. No.: 21,315

[22] Filed: Mar. 16, 1979

[30] Foreign Application Priority Data

Mar. 7, 1979 [CH] Switzerland ..... 24446/79

[51] Int. Cl.[3] ..... B26F 3/02

[52] U.S. Cl. ..... 225/106; 206/409; 225/42; 225/48; 225/78

[58] Field of Search ..... 225/48–50, 225/106, 52, 78, 42; 206/409

[56] References Cited

U.S. PATENT DOCUMENTS

| | | | |
|---|---|---|---|
| 632,686 | 9/1899 | Bingaman | 225/78 X |
| 1,423,336 | 7/1922 | Korittke | 225/42 X |
| 2,213,499 | 9/1940 | McCaskey | 225/48 X |
| 2,806,591 | 9/1957 | Appleton | 225/106 |
| 2,861,753 | 11/1958 | Sipior | 225/91 X |
| 3,477,624 | 11/1969 | Branyon et al. | 225/48 X |
| 3,868,052 | 2/1975 | Rockefeller | 225/106 |
| 3,986,479 | 10/1976 | Bonk | 225/106 X |
| 4,171,047 | 10/1979 | Doyle et al. | 225/106 X |

FOREIGN PATENT DOCUMENTS

| | | | |
|---|---|---|---|
| 541507 | 5/1957 | Canada | 225/52 |
| 517529 | 2/1940 | United Kingdom . | |
| 1352519 | 5/1974 | United Kingdom . | |

*Primary Examiner*—Frank T. Yost
*Attorney, Agent, or Firm*—Holman & Stern

[57] ABSTRACT

A dispenser for a material wound into hollow cylindrical self-supporting roll is provided. The dispenser wall or walls adjacent to the circumference of the roll are provided with a first aperture through which the material, unwindable from the outside of the cylindrical roll can be drawn from the dispenser and a wall adjacent to an end face of the roll is provided with a second aperture through which the material unwindable from the inside of the roll, can be drawn from the dispenser.

9 Claims, 8 Drawing Figures

DISPENSER FOR WEB-LIKE MATERIAL

BACKGROUND OF THE INVENTION

1. Field of the Invention

The present invention relates to a dispenser for a material wound into a hollow, cylindrical, self-supporting roll.

Dispensers for all sorts of rolled-up materials, such as, paper, fabrics, plastic and metal foils and the like, are known. These known dispensers suffer, however, from a drawback in that they are usable with convenience only in certain well-defined positions not necessarily identical with positions best suited for a given application.

2. Summary of the Invention

It is the object of the invention to overcome this drawback and to provide a dispenser both simple and inexpensive, from which it is possible to draw material regardless of its position.

This object the invention achieves by providing a dispenser for a material wound into a hollow, cylindrical, self-supporting roll, wherein the dispenser wall or walls adjacent to the circumference of the roll are provided with at least one first aperture means through which the material, unwindable from the outside of said cylindrical roll, can be drawn from said dispenser, and wherein at least one of the two dispenser walls adjacent to the end faces of said roll is provided with second aperture means through the central zone of which passes the roll axis, through which second aperture means the material, unwindable from the inside of said roll, can be drawn from said dispenser.

The dispenser according to the invention can be made of any material, such as, cardboard, plastics, wood, metal and, if used with a rigidifying insert, also of plastic foil.

While the invention will now be described in connection with certain preferred embodiments, it will be understood that it is not intended to limit the invention to these particular embodiments. On the contrary, it is intended to cover all alternatives, modifications and equivalent arrangements as may be included within the scope of the invention as defined by the appended claims. Nevertheless, it is believed that embodiments of the invention will be more fully understood from a consideration of the following illustrative description read in conjunction with the accompanying drawings, in which:

DESCRIPTION OF THE PREFERRED EMBODIMENTS

Figure 1:
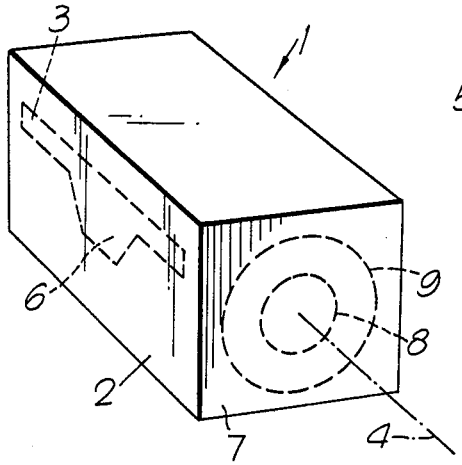
FIG. 1 shows a perspective view of a dispenser with perforations for the tearing-out of a slot and of two concentric holes.

There can be seen in FIG. 1 a dispenser 1 consisting of an elongated cardboard box of substantially square cross section containing a hollow, cylindrical material roll. This roll is self-supporting, i.e., not wound on a core. Wall 2 of the four side walls adjacent to the cylindrical surface of the roll, shown in the drawing on the left side, is provided with a perforation 3 for tearing-out a slot 5 (FIG. 2) parallel to the axis 4 of the roll. The central zone 6 of the slot perforation 3 is widened in the downward direction. Wall 7 of the dispenser 1, as seen in the drawing, the front wall of the two walls adjacent to the end faces of the roll, is provided with two substantially concentric, circular perforations 8 and 9, the center of the two circles lying approximately on the axis 4 of the roll.

Figure 2:
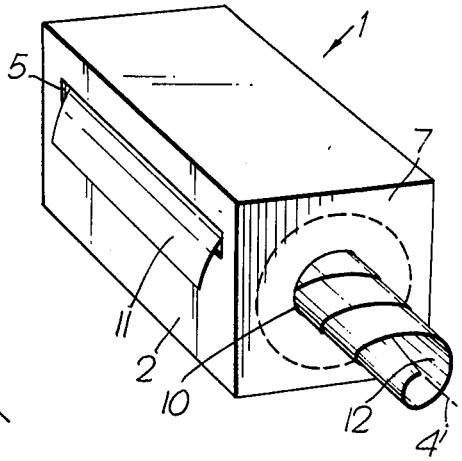
FIG. 2 is a perspective view of the dispenser according to FIG. 1, with torn-out slot and inner hole, and with material drawn from both slot and hole.

In FIG. 2, the slot 5 in the side wall 2 and a hole 10 in the end wall 7 are formed by tearing-out the perforations 3 and 8, respectively. This permits, on the one hand, the outer end 11 of the material web to be drawn from the dispenser 1 off the outside of the roll through the slot 5 and, on the other hand, the inner end 12 of the material web to be drawn from the box 1 off the inside of the roll through the hole 10. The widened central zone 6 of the slot 5 facilitates gripping of the outer end 11 on the roll. The diameter of the hole 10 (or of the perforation 8) is designed to be slightly larger than the inside diameter of the hollow cylinder of the (full) material roll, which was found to be convenient for the gripping and drawing of the inner end 12 of the material web. With progressing unwinding of the material from the inside of the roll, the inside diameter of the latter increases, making drawing of material through the hole 10 increasingly difficult. For this reason, the perforation 9 is torn out after part of the material web has been drawn from the inside of the roll.

Figure 3:
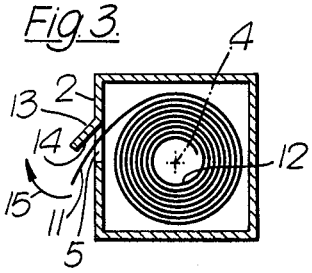
FIG. 3 is a cross-sectional view of a variant of the dispenser shown in FIG. 1, to reduced scale.

In the variant of the dispenser 1 shown in FIG. 3, a part 13 of the container wall 2 is angularly bent so as to project over the slot 5. The lower side of the part 13 is provided with a strip 14 on the surface of which there are mounted small hooks, offering a strong frictional resistance to a web drawn across it. The desired length of the outer material web 11 having been drawn, the web can now be applied against the strip 14 in the direction of the arrow 15. The small hooks of the strip 14 prevent further drawing of the material which can now be torn off by a sudden pulling.

Figure 4:
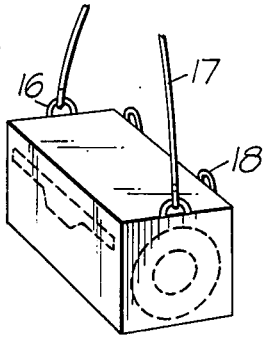
FIGS. 4–6 are perspective views of variants of the dispenser according to FIG. 1, to reduced scale.

FIG. 4 shows an embodiment in which lugs 16 are attached to both end faces of the dispenser, to which is attached a carrying strap 17. Two further lugs are attached to the side wall opposite the slot perforation and serve for hanging the box on a wall. A bag for disposal of used material may be attached to the rear lug 16.

Figure 5:
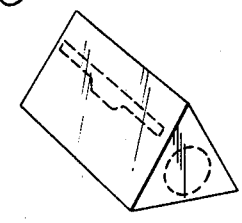
Figure 6:
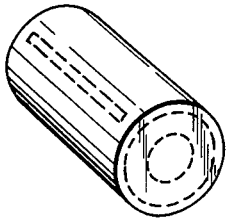

In the embodiments shown in FIGS. 5 and 6, the dispenser is in the form of the three-sided prism and a cylinder, respectively.

Figure 7:
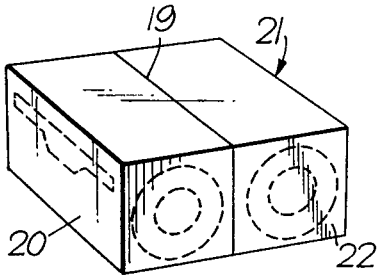
FIG. 7 is a perspective view of a dispenser constituted by joining two identical dispensers.

The dispenser shown in FIG. 7 has two internal chambers, separated by a partition 19, for two rolls. At the opposite side walls 20, 21 of the dispenser there are provided perforations for tearing-out of a slot for each roll and at the frontal end wall 22 there are provided two concentric, circular perforations for each roll, for tearing-out of holes. This type of dispenser is particularly suitable for two rolls of different materials to be used together, e.g., a fabric soaked in a detergent on one side and an absorbent paper on the other. Instead of being arranged one besides the other, these chambers can also be arranged one behind the other, i.e., along a substantially common axis.

In another embodiment of the dispenser (not shown), the hole 10 or the hole obtained by tearing-out the perforation 9 is covered by a movable flap elastically or yieldingly held against the end wall 7, which flap, in order to draw material 12, must be swung away from the wall 7. The hole is also closable by a push-on cap or by means of a cover slidably or rotatably mounted on the end wall 7. The slot can be covered up in a similar way. Closing the hole or the slot when the dispenser is not in use prevents soiling of the material in the dispenser.

The dispensers shown in the Figures are meant to be thrown away once the roll has been used up. However, the dispensers can also be provided with a swing-open wall, known per-se for replacement of the rolls, in which case they are advantageously made of plastic, metal or wood, instead of cardboard.

The slot 5 and the hole 10 made in the wall or walls of the dispenser may be of any desired known per-se shape or configuration and may be fitted along the edges thereof with means for facilitating the tearing of the web material contained therein. Furthermore, the material itself may be provided with cross or even oblique perforations for facilitating easy tearing.

According to the available space, the dispenser described can be mounted or put up in different positions, the material being always readily and easily drawn either through the hole or through the slot. In use, it is advantageous to first tear open only one perforation, i.e., either the hole or the slot. (The roll is less liable to be soiled and the dispenser stays more stable). Thus, using the dispenser when carried with the aid of a strap 17 (FIG. 4), it might be good practice to tear-out the hole, as in the carried position the end wall is more accessible. If, later. the dispenser is hung on a wall, using the lugs 18, the slot should be torn open, as now the side wall is better accessible. If, for instance, due to jamming of the roll because of deformation of the dispenser during transport, the material cannot be drawn off from the outside, or if, because of, e.g., flaws in the material, the latter cannot be drawn from the inside of the roll, it is in most cases still possible to draw the material off the other (inner or outer side of the roll).

Figure 8:
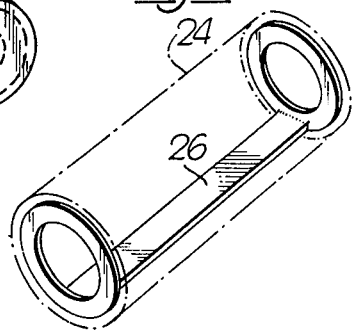
FIG. 8 is a perspective view of a bag-type dispenser.

It should be understood that, instead of a dispenser made of a rigid material, the dispenser may consist of a bag 24 (FIG. 8) made of plastic foil and containing an insert 26 holding the roll and made of a rigid material such as a plastic or the like. This insert imparts to the plastic bag a substantially permanent shape facilitating its use as a dispenser. The bag may be provided with perforations of the above-mentioned types or, alternatively, may be provided with ready-made apertures.

Finally, it will be evident to those skilled in the art that the invention is not limited to the details of the foregoing illustrative embodiments and examples and that the present invention may be embodiment in other specific forms without departing from the spirit or essential attributes thereof, and it is, therefore, desired that the present embodiments be considered in all respects as illustrative and not restrictive, reference being made to the appended claims, rather than to the foregoing description, in which it is intended to claim all modifications coming within the scope and spirit of the invention.

I claim:

1. A dispenser for a coreless material wound into a hollow, cylindrical, self-supporting roll contained therein, wherein the dispenser comprises a wall portion adjacent to the circumference of the roll and two ends adjacent to the end faces of said roll, said wall portion being provided with at least one first elongated aperture means through which the material, unwindable from the outside of said cylindrical roll, can be drawn from said dispenser, and wherein at least one of the two dispenser ends adjacent to the end faces of said roll is provided with second aperture means through a central zone of which passes the roll axis, through which second aperture means the material, unwindable from the inside of said roll, can be drawn from said dispenser.

2. The dispenser as claimed in claim 1, wherein said at least one first elongated aperture means and said second aperture means are formed by removing perforated portions to provide a slot and hole, respectively.

3. The dispenser as claimed in claim 1, wherein said first aperture means consists of a slot extending parallel to the roll axis, and wherein said second aperture means consists of a hole.

4. The dispenser as claimed in claim 2 or 3, wherein said at least one of two dispenser ends is provided with perforations for tearing-out a second hole, larger than the first hole, so that after unwinding and drawing off part of the material from the inside of said roll, tearing-out of said second hole will facilitate the drawing from said dispenser of the rest of the material, unwindable from the inside of said roll.

5. The dispenser as claimed in claim 3, wherein a part of said dispenser wall is angularly bent so as to project over said slot, said part being provided with a surface facing said slot, which surface is adapted to offer said material, when pulled across said surface, a frictional resistance, whereby a sudden pull will cause said material to be torn off.

6. The dispenser as claimed in claims 1 and 3, wherein said dispenser consists of a bag made of plastic foil provided with said aperture means, and wherein said bag contains an insert holding said roll, which insert is made of a rigid material and imparts to said plastic bag a substantially permanent shape facilitating its use as a dispenser.

7. The dispenser as claimed in claim 1, wherein a carrying strap is attached to said dispenser.

8. The dispenser as claimed in claim 1, wherein said dispenser is provided with suspension lugs.

9. The dispenser as claimed in claim 1, wherein said dispenser is constituted by joining two identical dispensers, each accommodating at least one roll.

* * * * *